US006536406B2

(12) United States Patent
Matsubara et al.

(10) Patent No.: US 6,536,406 B2
(45) Date of Patent: Mar. 25, 2003

(54) IGNITION SYSTEM FOR INTERNAL COMBUSTION ENGINE

(75) Inventors: Yoshihiro Matsubara, Mie (JP); Kenji Ishida, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 09/790,868

(22) Filed: Feb. 23, 2001

(65) Prior Publication Data

US 2001/0017125 A1 Aug. 30, 2001

(30) Foreign Application Priority Data

Feb. 24, 2000 (JP) ..... 2000-048232

(51) Int. Cl.[7] ..... F02P 15/08
(52) U.S. Cl. ..... 123/310; 123/638
(58) Field of Search ..... 123/310, 638

(56) References Cited

U.S. PATENT DOCUMENTS 2,025,203 A * 12/1935 Harper, Jr. ..... 123/638
2,899,585 A 8/1959 Dollenberg
3,964,454 A * 6/1976 Nishimiya ..... 123/638
5,954,024 A * 9/1999 Duhr et al. ..... 123/310

FOREIGN PATENT DOCUMENTS

JP 59-173558 A 10/1984
JP 59-173558 * 10/1984 ..... 123/310
JP 2-60081 A 2/1990
JP 4-140478 A 5/1992
JP 6-33857 A 2/1994
JP 6-221257 A 8/1994
JP 8-4641 A 1/1996
JP 11-135229 A 5/1999
JP 11-135229 * 5/1999 ..... H01T/13/14

OTHER PUBLICATIONS

Office Action for Japanese Application No. 2000–48232 dated Aug. 19, 2002.

* cited by examiner

*Primary Examiner*—Andrew M. Dolinar
(74) *Attorney, Agent, or Firm*—Sughrue Mion, PLLC

(57) ABSTRACT

An ignition system for an internal combustion engine. At least one of a plurality of spark plugs 4 and 5 attached to each of cylinders 2A, 2B, 3B, and 3A is a self-cleaning spark plug A.

19 Claims, 16 Drawing Sheets

SPARK PLUG A

SPARK PLUG B (e)
(f)
MG
EG
4
5
51
52
53
54
55

MG
EG
4
5
51
52
53
54
55

SPARK PLUG A

IGNITION SYSTEM FOR INTERNAL COMBUSTION ENGINE

BACKGROUND OF THE INVENTION

1. Field of the Invention

The present invention relates to an ignition system for an internal combustion engine.

2. Description of the Related Art

Advancement in performance of an internal combustion engine, such as an automobile gasoline engine, has recently been accompanied by use of a so-called multi-ignition engine, in which each cylinder is equipped with a plurality of spark plugs. The multi-ignition engine exhibits excellent ignition performance and is favorably applicable particularly to a lean-burn engine.

When a spark plug is used for a long period of time at a low temperature not higher than 450° C.; for example, during predelivery, the spark plug becomes "carbon fouled" (sooted) or "wet fouled" (covered with fuel). In such a state, the insulator surface is covered with a conductive contaminant, such as carbon, which causes defective operation. In the above-described conventional multi-ignition engine, the type and polarity of spark plugs mounted thereon have been determined without sufficiently considering the prevention of contamination.

SUMMARY OF THE INVENTION

A first object of the present invention is to provide an ignition system for an internal combustion engine having improved ignition performance by attaching a plurality of spark plugs to each cylinder which are less susceptible to contamination. A second object of the present invention is to provide a method for simplifying the electrical configuration of an ignition system having a plurality of spark plugs attached to each cylinder.

The above first object of the present invention has been achieved by providing an ignition system for an internal combustion engine having a multi-ignition cylinder equipped with a plurality of spark plugs serving as ignition sources, characterized in that at least one of the spark plugs is a self-cleaning spark plug capable of removing, by means of discharge spark, contaminants adhering to an insulator surface facing a spark discharge gap of said self-cleaning spark plug.

In an internal combustion engine having a multi-ignition cylinder (hereinafter, also called a multi-ignition-type internal combustion engine), where at least one of a plurality of spark plugs attached to the cylinder is a self-cleaning spark plug as in the case of the present invention, the spark plug becomes unlikely to suffer contamination such as soot accumulation, thereby effectively preventing a problem of engine start-up failure. Even when some spark plugs are contaminated, the self-cleaning spark plug reliably ignites a fuel-air gas mixture. When the temperature of the engine rises sufficiently high, the contaminated spark plugs are cleaned; thus, good ignition can be maintained at all times.

The self-cleaning spark plug can be a surface-gap spark plug comprising a center electrode; an insulator, which is disposed around the center electrode such that an end portion of the center electrode is exposed at an end surface thereof; and a ground electrode. The relative positions of the ground electrode, an end portion of the insulator and the end portion of the center electrode are determined such that a spark discharge gap is defined between the ground electrode and the end portion of the center electrode and such that the discharge gap enables creeping spark discharge across the surface of the end portion of the insulator. The surface-gap spark plug allows a spark discharge to creep across the surface of the insulator, thereby burning an adhering contaminant at all times and thus exhibiting improved resistance to contamination as compared with an air-gap-type spark plug.

Meanwhile, a self-cleaning spark plug, such as a surface-gap spark plug, involves frequent occurrence of a spark which creeps across or attacks the surface of an insulator, and thus tends to suffer so-called channeling, or the surface of the insulator is abraded. Progress of channeling is apt to impair heat resistance or reliability of a spark plug. Channeling is particularly apt to occur during high-speed or heavy-load operation. With the recent trend toward high engine output, there has been demand for spark plugs of excellent durability, and there is a need to prevent or suppress channeling. Channeling can be effectively prevented by employing a high-voltage applicator for applying a discharge-inducing high voltage to the center electrode and the ground electrode of the self-cleaning spark plug such the center electrode assumes a positive polarity. The mechanism disclosed in Japanese Patent Application Laid-Open (kokai) No. 11-135229 illustrates why application of voltage so as to establish the above-mentioned polarity effectively prevents channeling to an insulator.

The above second object of the present invention is achieved by providing an ignition system for an internal combustion engine having a plurality of multi-ignition cylinders, each equipped with a plurality of spark plugs serving as ignition sources, characterized in that:

The multi-ignition cylinders are each equipped with a positive-polarity spark plug, to which a discharge-inducing high voltage is applied such that a center electrode of the positive-polarity spark plug assumes a positive polarity, and a negative-polarity spark plug, to which a discharge-inducing high voltage is applied such that a center electrode of the negative-polarity spark plug assumes negative polarity; and comprising an ignition coil for generating the discharge-inducing high voltage configured such that a positive end of a secondary coil is connected to the positive-polarity spark plug, whereas a negative end of the same secondary coil is connected to the negative-polarity spark plug.

According to the above configuration, a positive-polarity spark plug and a negative-polarity spark plug share a single secondary coil, thereby reducing the number of ignition coils and thus significantly simplifying the electrical configuration of an ignition system employing multi-ignition cylinders.

Figure 1:
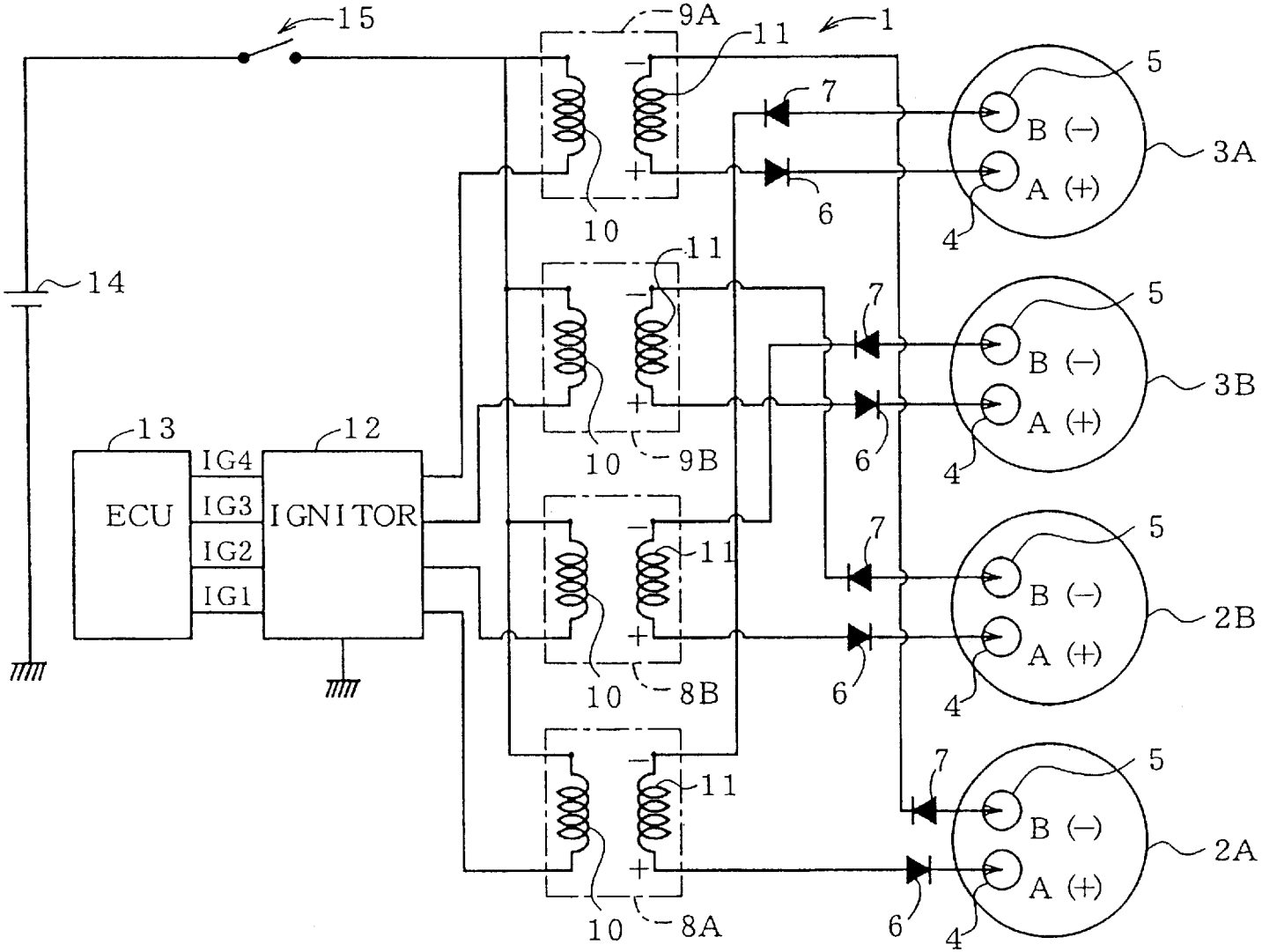
FIG. 1 is a block diagram showing an example of an ignition system for an internal combustion engine of the present invention.

Reference numerals are used to identify items shown in the drawings as follows:

1, 100, 150, 200: ignition systems for an internal combustion engine
2A, 2B: cylinders (multi-ignition cylinders; first cylinders)
3A, 3B: cylinders (multi-ignition cylinders; second cylinders)
4: spark plug A (self-cleaning spark plug; semi-surface-gap spark plug; positive-polarity spark plug)
5: spark plug B (opposed-parallel-electrodes spark plug; negative-polarity spark plug)
6: diode
7: diode
8A, 8B, 8: first ignition on coils (high-voltage applicator)
9A, 9B, 9: second ignition on coils (high-voltage applicator)
10: primary coil
11: secondary coil
12: igniter (high-voltage applicator)
13: control unit (ECU; high-voltage applicator)
14: battery
15: ignition switch
17: negative-polarity ignition coil
18, 18': positive-polarity ignition coils
22, 32: center electrodes
23, 33: insulators
24, 34: ground electrodes
25, 35, 36: noble-metal spark portions
g, g1, g2: spark discharge gaps
26, 36: male-threaded portions
27, 37: metallic shells
51: cylinder (multi-ignition cylinder)
52: piston
53: combustion chamber
54: intake valve
MG: fuel-air gas mixture
55: exhaust valve
EG: exhaust gas
64: spark plug A (self-cleaning spark plug; intermittent-surface-gap spark plug; positive-polarity spark plug)
104: semi-surface-gap spark plug (self-cleaning spark plug)
164: intermittent-surface -gap spark plug (self-cleaning spark plug)
264: intermittent-surface-gap spark plug (self-cleaning spark plug)

DESCRIPTION OF THE PREFERRED EMBODIMENTS

FIG. 1 is a block diagram conceptually showing an embodiment of an ignition system for an internal combustion engine of the present invention. The internal combustion engine is a multi-cylinder gasoline engine equipped with a plurality of cylinders; specifically, four cylinders 2A, 2B, 3B, and 3A in the present embodiment. The cylinders 2A, 2B, 3B, and 3A each assumes the form of a multi-ignition cylinder equipped with a plurality of spark plugs; specifically, two spark plugs 4 and 5 in the present embodiment.

Figure 2:
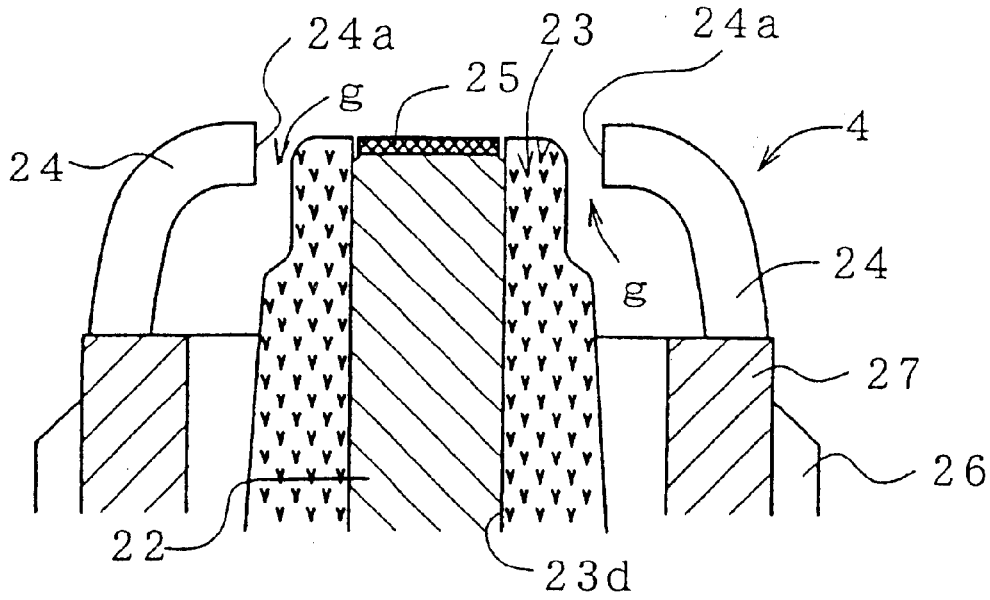
FIG. 2 shows longitudinal sectional views of a main portion of a positive-polarity spark plug and a negative-polarity spark plug used in the ignition system of FIG. 1.
Figure 2:
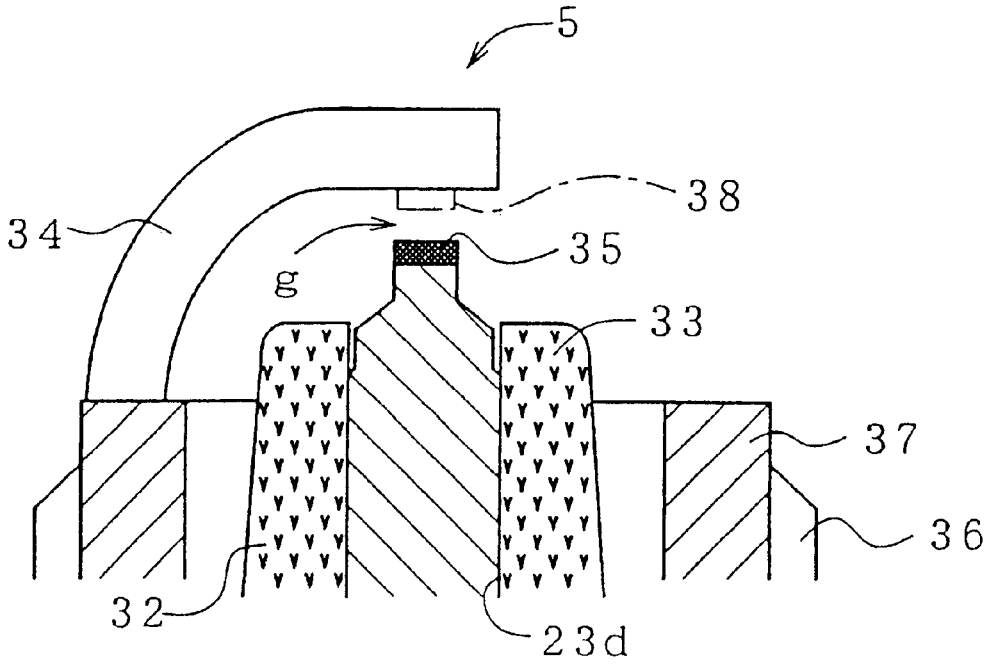

The spark plug 4 attached to each cylinder is a self-cleaning spark plug (hereinafter, also called a spark plug A). As shown in FIG. 2, the spark plug A is a surface-gap spark plug and includes a center electrode 22; an insulator 23, which is disposed around the center electrode 22 such that an end portion of the center electrode 22 is exposed at the end surface thereof; and a ground electrode 24. The positional relations thereof with an end portion of the insulator 23 and the end portion of the center electrode 22 are determined such that a spark discharge gap g is defined between the ground electrode 24 and the end portion of the center electrode 22, and such that the discharge gap g enables creeping spark discharge across the surface of the end portion of the insulator 23.

More specifically, the spark plug A assumes the form of a so-called semi-surface-gap spark plug. The ground electrode 24 is disposed such that an end surface faces the side surface of the center electrode 22 while an end portion of the insulator 23 is disposed therebetween. The insulator 23 is formed, for example, from a sintered ceramic body, such as alumina or aluminum nitride. A hole portion (through-hole) 23*d* is formed in the insulator 23 so as to extend axially through the same. The center electrode 2 is fitted into the hole portion 23*d*. A metallic shell 27 is formed from a metal, such as low-carbon steel, and is formed into a cylindrical shape to thereby serve as a housing of the spark plug A. A male-threaded portion 26 is formed on the outer surface of the metallic shell 27 and is adapted to attach the spark plug 4 to a cylinder head.

The insulator 23 is disposed such that an end portion thereof is disposed between the side surface of the center electrode 22 and a spark face 24*a* of the ground electrode 24. A noble-metal member made of a Pt alloy or an Ir alloy is welded to the end surface of the center electrode 22 to thereby form a noble-metal spark portion 25. The end surface of the center electrode 22 (the noble-metal spark portion 25) is adjusted in position so as to be substantially flush with the end surface of the insulator 23.

The spark plug 5 is a so-called opposed-parallel-electrodes spark plug (hereinafter, also called a spark plug B). Specifically, the spark plug B includes a cylindrical metallic shell 37 (having a male-threaded portion 36 formed thereon); an insulator 33, which is fitted into the metallic shell 37 such that an end portion thereof projects from the same; a center electrode 32 having an end portion thereof tapered off and fitted into the hole portion 23*d* formed in the insulator 33 such that the end portion projects from the insulator 33; and a ground electrode 34 having one end connected to the metallic shell 37, for example, by welding and having the other end bent such that the side surface thereof faces the end portion of the center electrode 32. A noble-metal member of a Pt alloy or an Ir alloy is welded to the end of the center electrode 32 to thereby form a noble-metal spark portion 35 and define a spark discharge gap g in cooperation with the ground electrode 34. A noble-metal spark portion 38 may be formed on the ground electrode 34 in opposition to the spark portion 35 of the center electrode 32, or may be omitted.

As shown in FIG. 1, two spark plugs A and B are attached to each of the cylinders 2A, 2B, 3B, and 3A where the spark plug A is a self-cleaning spark plug, such that the spark plugs A and B become unlikely to suffer contamination such as soot accumulation. Even when the spark plug B is contaminated, the spark plug A in the form of a self-cleaning spark plug reliably ignites a fuel-air gas mixture. When the temperature of the engine rises sufficiently high, the contaminated spark plug B is cleaned; thus, good ignition conditions can be maintained at all times.

In FIG. 2, a discharge-inducing high voltage is applied to the spark plug A (4), which serves as a self-cleaning spark plug, such that the center electrode 22 assumes a positive polarity. Hereinafter, a spark discharge induced by applying a discharge-inducing high voltage to a spark plug such that the center electrode assumes positive polarity is called a positive-polarity discharge, whereas a spark discharge induced while the center electrode assumes negative polarity is called a negative-polarity discharge. The spark plug A (4) is also called a positive-polarity spark plug A. Thus, channeling to the insulator 23 is unlikely to occur. A peripheral portion of a cylinder head, to which a spark plug is attached, is occupied by a cooling mechanism. As a result of expansion of the mechanism for improving cooling efficiency, a space for attaching a spark plug tends to be reduced. Thus, in recent years, a decrease in the size of a spark plug; specifically, a decrease in the diameter of a male-threaded portion of the spark plug (reduction to, for example, M12 or M10 size), has been required in many cases. Generally, as the size of the male-threaded portion is decreased, the diameter of a center electrode is decreased. As a result, a creeping spark discharge across the surface of an end portion of the insulator 23 occurs in a concentrated condition; thus, channeling is more apt to occur. Since the width of a ground electrode across which the ground electrode is welded to a metallic shell must be decreased, channeling is also more apt to occur. By employing a positive-polarity spark plug, channeling can be effectively prevented. Herein, the nominal size of a male-threaded portion of a spark plug conforms to ISO2705 (M12) and ISO2704 (M10); thus, the size of the male-threaded portion may vary within a tolerance specified in the ISO standard.

The present inventors conduct ed various studies and found that, as compared with a negative-polarity discharge, a positive-polarity discharge tends to cause an increase in the temperature of the center electrode 22 with a resultant slightly higher consumption rate of the electrode (noble-metal spark portion). Thus, by employing the positive-polarity spark plug A whose metallic shell 27 has a male-threaded portion of the above-mentioned small size, a water jacket portion of a cylinder head can be expanded, thereby accelerating cooling of the center electrode 22 effected by means of the water-cooled cylinder head via the insulator 23 and the metallic shell 27 and thus effectively suppressing consumption of the electrode. Also, a temperature rise of the insulator 23 is lessened, thereby further preventing channeling to the insulator 23, which is primarily achieved by employing a positive-polarity discharge. Moreover, an effect peculiar to configuration of a multi-ignition cylinder is obtained. That is, even when a space for attaching of a spark plug to a cylinder head is limited, a plurality of spark plugs can be readily attached to the cylinder head by reducing the nominal size of the male-threaded portion.

Next, when a plurality of spark plugs A and B are attached to the same multi-ignition cylinder while a positive-polarity spark plug A serves as a self-cleaning spark plug, spark plugs other than the self-cleaning spark plug each preferably is a negative-polarity spark plug B, to which a discharge-inducing high voltage is applied such that a center electrode thereof assumes a negative polarity. This is because the negative-polarity spark plug B maintains a discharge similar to a glow-corona discharge in the vicinity of the tip end of the electrode and thus exhibits better igniting performance. Thus, the combination of the negative-polarity spark plug B and the self-cleaning spark plug yields the following advantageous effects in relation to the effect of preventing contamination. The self-cleaning spark plug (A), which is of the creeping-discharge type, is of positive polarity and is slightly inferior in igniting performance to the negative-polarity spark plug (B), which is of the opposed-parallel-electrodes type. However, because of excellent resistance to contamination, the self-cleaning spark plug (A) ignites a fuel-air gas mixture, in place of the contaminated negative-polarity spark plug (B), when the negative-polarity spark plug (B) is contaminated. Thus, the self-cleaning spark plug (A) can reliably ignite the fuel-air gas mixture at the initial stage of start-up of an engine, when the temperature of the engine is low. In this case, the following secondary effect is obtained. For example, by enhancing combustion efficiency at low-temperature start-up, the temperature of exhaust gas can be increased quickly, thereby accelerating activation of a catalyst, such as a three-way catalytic converter, for purification of exhaust gas. As a result, unburnt components, such as HC, that are apt to be emitted immediately after the engine is started can be removed efficiently.

When the engine temperature rises sufficiently high, the negative-polarity spark plug B is released from a contaminated state, whereby stable operation with few misfires can be realized by utilizing excellent igniting performance of the negative-polarity spark plug B. Particularly, in a lean-burn engine, which uses a lean fuel-air gas mixture and requires high energy for ignition, the negative-polarity spark plug B can reliably ignite the lean fuel-air gas mixture.

In this case, the self-cleaning spark plug (A), which is a positive-polarity spark plug, and the negative-polarity spark plug B may be both operated at ignition timing. Alternatively, either the self-cleaning spark plug (A) or the negative-polarity spark plug B may be fired during a certain period of time which is determined according to operating conditions of an engine; for example, only the self-cleaning spark plug (A) is operated at an initial stage of start-up of an engine, during which time contamination of a spark plug raises a problem, and the negative-polarity spark plug B is operated only after the engine temperature rises sufficiently high.

The opposed-parallel-electrodes spark plug 5 used in the present embodiment can preferably serve as the negative-polarity spark plug B in terms of igniting performance. Particularly, imparting of a tapering-off feature to an end portion of the center electrode 32 as shown in FIG. 2 is advantageous in generating discharge sparks of high energy, since an electric field is apt to concentrate at a spark portion. Imparting of a tapering-off feature to an end portion of the center electrode 32 is also effective for preventing misfire, since the end portion is less likely to absorb heat of combustion gas.

The igniting performance of the opposed-parallel-electrodes spark plug 5 can be improved by slightly expanding the spark discharge gap g. However, an excessively wide spark discharge gap g involves a problem that, when a surface of the insulator 33 located within the metallic shell 37 is contaminated, discharge is apt to occur where the distance between the surface of the insulator 33 and the inner wall surface of the metallic shell 37 is less than the spark discharge gap g; i.e., a problem that contamination resistance is impaired. In order to avoid impairing contamination resistance, expansion of the spark discharge gap g is limited (for example, a typical conventional opposed-parallel-electrodes spark plug has a spark discharge gap of about 0.6 mm to 0.9 mm). However, in the case in which the opposed-parallel-electrodes spark plug is used in combination with a self-cleaning spark plug (in the present embodiment, semi-surface-gap spark plug 4), the self-cleaning spark plug serves as an ignition source when the opposed-parallel-electrodes spark plug is contaminated. Therefore, the spark discharge gap g can be expanded to, for example, 1.0 mm to 1.3 mm, without the above-mentioned limitation.

The electrical configuration of the ignition system 1 of FIG. 1 will be described in detail. As mentioned previously, the ignition system 1 is applied to a multi-cylinder-type internal combustion engine including a plurality of multi-ignition cylinders, each of which is equipped with the positive-polarity spark plug A (self-cleaning spark plug (semi-surface-gap spark plug) 4) and the negative-polarity spark plug B (opposed-parallel-electrodes spark plug). Ignition coils 8A, 8B, 9B, and 9A constitute a high-voltage applicator. The positive end of a secondary coil 11 of each of the ignition coils 8A, 8B, 9B, and 9A is connected to the corresponding positive-polarity spark plug A, whereas the negative end of the same secondary coil 11 is connected to the corresponding negative-polarity spark plug B. Thus, the two spark plugs A and B of different polarities share the same ignition coil, thereby simplifying the configuration of the ignition system.

The present embodiment employs first ignition coils 8A and 8B and second ignition coils 9A and 9B. The positive end of the secondary coil 11 of the first ignition coil 8A (8B) is connected to the positive-polarity spark plug A of one multi-ignition cylinder (first cylinder 2A or 2B), whereas the negative end of the same secondary coil 11 is connected to the negative-polarity spark plug B of another multi-ignition cylinder (second cylinder 3A or 3B). The positive end of the secondary coil 11 of the second ignition coil 9A (9B) is connected to the positive-polarity spark plug A of the second cylinder 3A (3B), whereas the negative end of the same secondary coil 11 is connected to the negative-polarity spark plug B of the first cylinder 2A (2B). Thus, by means of a small number of ignition coils, spark plugs of different polarities attached to different cylinders can be operated efficiently.

In FIG. 1, the four cylinders 2A, 2B, 3A, and 3B are connected to the same crankshaft (not shown) to thereby constitute a 4-stroke engine. The cylinders 2A and 3A constitute a pair of the above-mentioned first and second cylinders, whereas the cylinders 2B and 3B constitute a pair of the above-mentioned first and second cylinders. In either pair, there is a phase difference of two strokes between the first cylinder and the second cylinder. Also, there is a phase difference of one stroke between the pairs. As a result, the four cylinders are connected to the crankshaft while a phase difference of one stroke is present between the cylinders.

Primary coils 10 of the corresponding ignition coils 8A, 8B, 9B, and 9A receive electricity from a battery 14 via an ignition switch 15 and are connected to an igniter 12. Assuming a known configuration, the igniter 12 includes contactless switch elements, which each include a power transistor, and a peripheral control circuit. The secondary coils 11 are connected to the corresponding spark plugs. The igniter 12 includes the contactless switch elements corresponding to the ignition coils 8A, 8B, 9B, and 9A. These contactless switch elements are opened individually at predetermined timing in response to individual opening instruction signals received from corresponding output ports (IG1 to IG4) of an electronic control unit (ECU) 13. The polarity of connection of the battery 14 to the center electrodes 22 and 32 (FIG. 2) and the direction of winding of the primary and secondary coils 10 and 11 are determined such that current is induced in the secondary coils 11 in the following manner: a terminal of the secondary coil 11 connected to the spark plug A assumes positive polarity, whereas a terminal of the secondary coil 11 connected to the spark plug B assumes negative polarity. Diodes 6 and 7 are disposed between spark plugs and the ignition coils 8A, 8B, 9B, and 9A in order to prevent resupply of electricity to the spark plugs when the contactless switch elements in the igniter 12 are restored to a closed state from an open state.

Each of the cylinders 2A, 2B, 3B, and 3A sequentially undergoes the intake stroke, the compression stroke, the expansion stroke, and the exhaust stroke in one cycle. Since there is a phase difference of two strokes between the first cylinders 2A and 2B and the second cylinders 3A and 3B, the ignition coils 8A, 8B, 9B, and 9A are operated so as to fire spark plugs attached to one of the first cylinders 2A and 2B and those attached to one of the second cylinders 3A and 3B for ignition of a fuel-air gas mixture, and simultaneously to fire spark plugs attached to the other one of the first cylinders 2A and 2B and those attached to the other one of the secondary cylinders 3A and 3B at a phase which is 2 strokes apart from ignition timing; i.e., at a timing different from the ignition timing. Accordingly, the spark plugs attached to the other cylinder of the first cylinders 2A and 2B and those attached to the other cylinder of the second cylinders 3A and 3B must be fired at a different timing for ignition of a fuel-air gas mixture.

Figure 4:
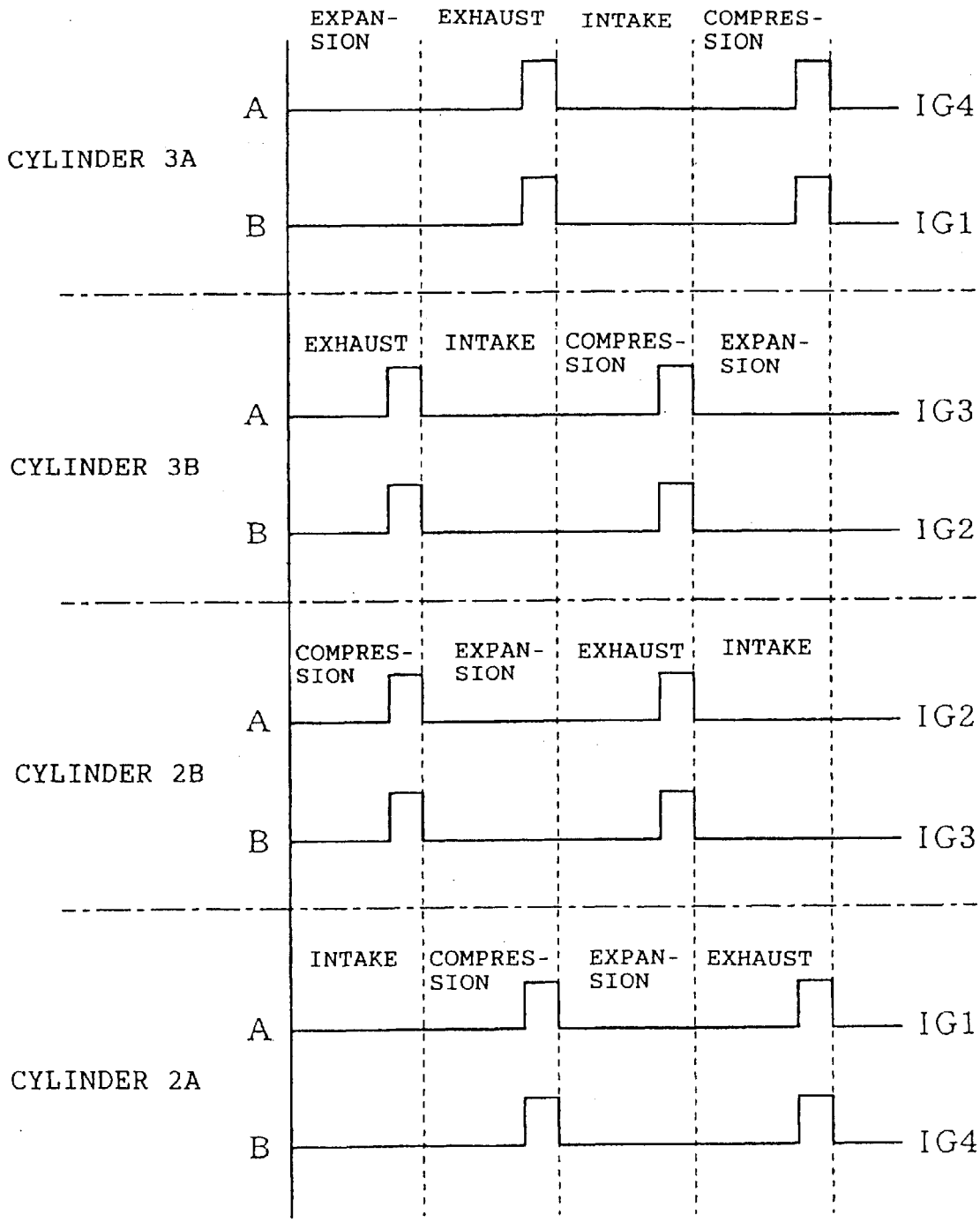
FIG. 4 is a timing chart showing the action of spark plugs used in the ignition system of FIG. 1.

FIG. 4 shows a timing chart of ignition instruction signals which are issued to the igniter 12 from the ECU 13 through the ports IG1 to IG4 (corresponding to the ignition coils 8A, 8B, 9B, and 9A). Herein, a rising edge from the L level to the H level serves as a trigger edge for an ignition instruction signal (i.e., the contactless switch element is opened so as to disconnect the primary coil 10, to thereby generate a discharge-inducing voltage at the corresponding spark plug via the secondary coil 11). As seen from FIG. 4, ignition instruction signals associated with the spark plugs A and B are issued through the ports at two timings when one of the paired cylinders (2A or 3A and 2B or 3B) is in the compression stroke, whereas the other one of the paired cylinders is in the exhaust stroke. For example, at the port IG1 corresponding to the first ignition coil 8A associated with the paired cylinders 2*a* and 3A, a first ignition instruction signal is issued when the first cylinder 2A is in the compression stroke, while the second cylinder 3A is in the exhaust stroke; and then a second ignition instruction signal is issued when the first cylinder 2A is in the exhaust stroke, while the second cylinder 3A is in the compression stroke. At the port IG4 corresponding to the second ignition coil 9A, the first and second ignition instruction signals are issued synchronously with issuance of the first and second ignition instruction signals associated with the first ignition coil 8A. The same signal patterns are output for the paired cylinders 2B and 3B through the port IG2 (corresponding to the first ignition coil 8B) and the port IG3 (corresponding to the second ignition coil 9B) except that the phase differs by one stroke.

Figure 3:
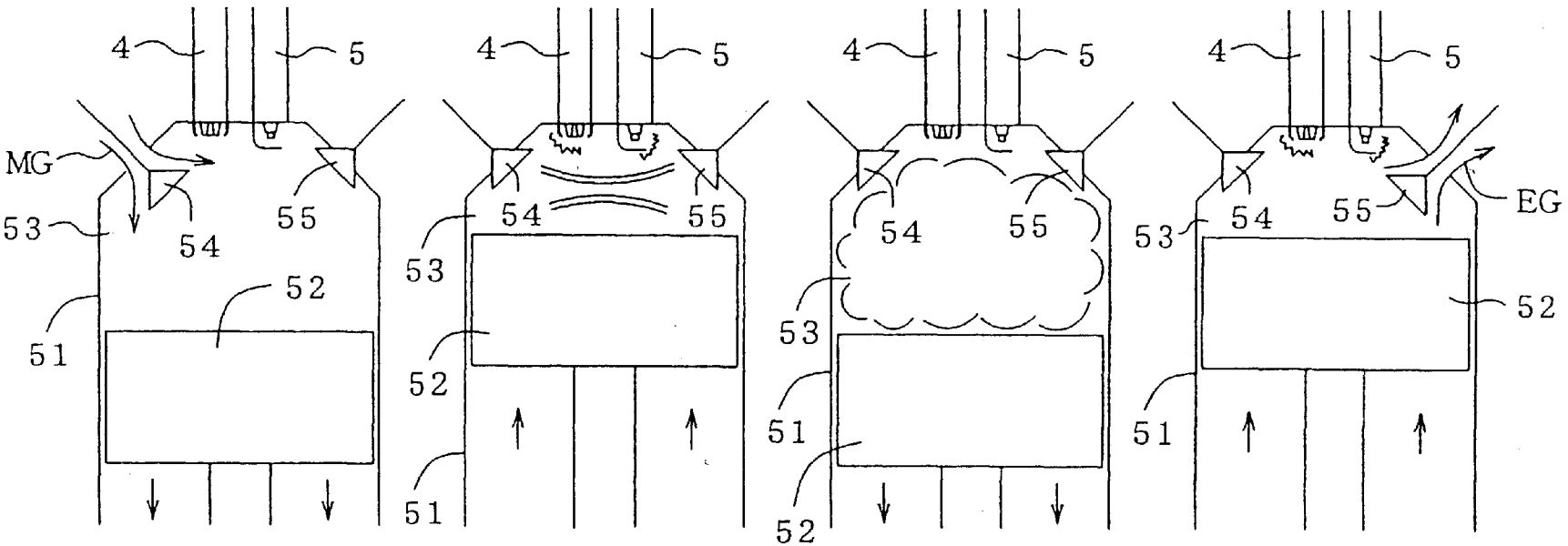
FIG. 3 shows views for explaining the actions of cylinders and spark plugs used in the ignition system of FIG. 1.

FIG. 3 schematically shows the actions of the cylinders 2A, 2B, 3B, and 3A (which, hereinafter, are generically represented by a cylinder 51 as needed). In FIG. 3, (*a*) represents the intake stroke; (*b*) represents the compression stroke; (*c*) represents the expansion (explosion) stroke; and (*d*) represents the exhaust stroke. In FIG. 3, reference numeral 52 denotes a piston; reference numeral 53 denotes a combustion chamber; reference numeral 54 denotes an intake valve; reference numeral 55 denotes an exhaust valve; symbol MG denotes a fuel-air gas mixture; and symbol EG denotes an exhaust gas. The spark plugs 4 and 5 are each fired twice in one cycle. Specifically, the spark plugs 4 and 5 are fired for ignition of MG at a substantial end stage of the compression stroke (for example, at a crank angle of 50° to 5° before a piston reaches the top dead center) as shown in (*b*) and are then fired again without contributing to ignition at the end stage of the exhaust stroke, which arises 2 strokes after the compression stroke, as shown in (*d*). The internal pressure of the combustion chamber 53 is low at the exhaust stroke, and the second firing breaks down at very low voltage. Thus, the second firing does not greatly accelerate consumption of an electrode.

High voltage for inducing a spark discharge for igniting of a fuel-air gas mixture; i.e., discharge-inducing high voltage, can be applied to at least two of a plurality of spark plugs attached to a multi-ignition cylinder at different timings. When the internal pressure of a combustion chamber increases to some extent as a result of firing of one spark plug, the other spark plug is fired to thereby ignite the fuel-air gas mixture, thereby enhancing combustion efficiency.

Figure 6:
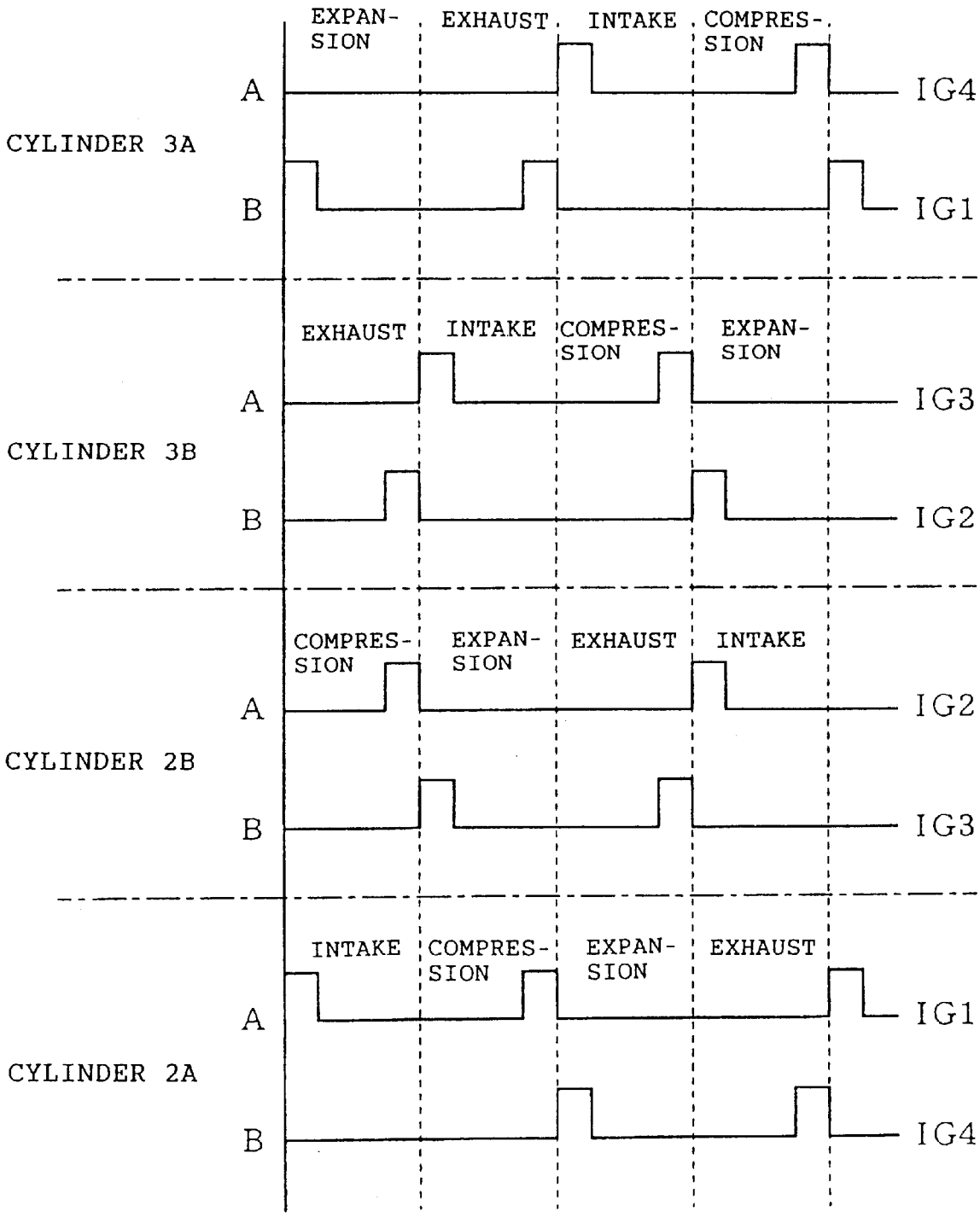
FIG. 6 is a timing chart showing the action of spark plugs corresponding to FIG. 5.

FIG. 6 shows an example of ignition timing in this case. The ignition timing pattern of FIG. 6 is basically similar to that of FIG. 4 except that the positive-polarity spark plug A is first fired, and the negative-polarity spark plug B is fired a predetermined time later. The positive-polarity spark plug A, which is resistant to contamination, is first fired to thereby perform initial ignition in a reliable manner. After combustion pressure increases, the negative-polarity spark plug B, which exhibits good igniting performance, is fired so as to reliably complement ignition. Notably, the ECU 13 may be programmed such that the spark plugs are fired at different timings only when a predetermined engine condition is established, such as during low-speed rotation or under medium load.

Figure 5:
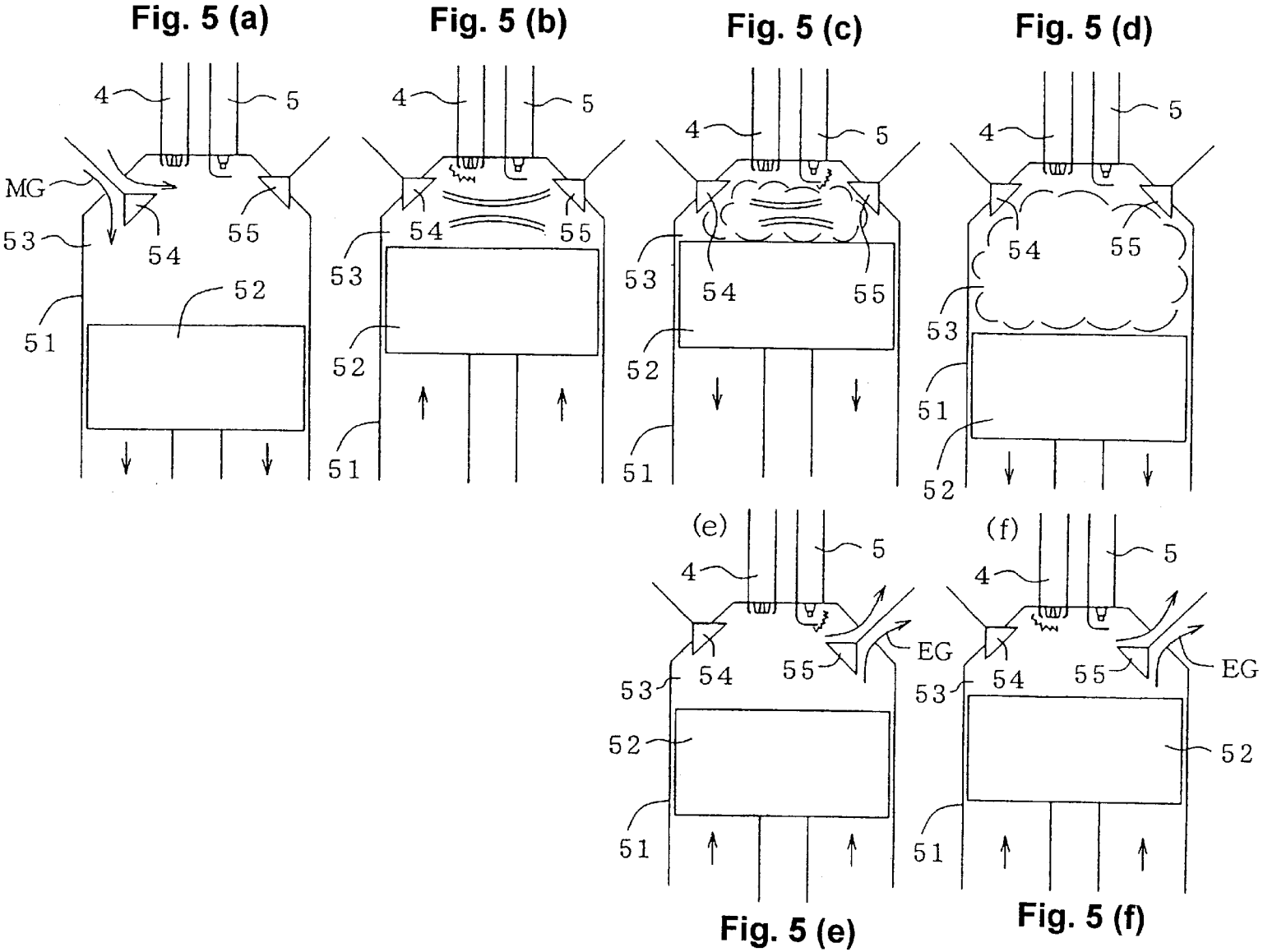
FIG. 5 shows views for explaining the action of cylinders and spark plugs when a positive-polarity spark plug and a negative-polarity spark plug are fired at different times.

FIG. 5 schematically shows the action of the cylinder 51 in one cycle. In FIG. 5, (*a*) represents the intake stroke; (*b*) represents the compression stroke; (*c*) and (*d*) represent the expansion (explosion) stroke; and (*e*) and (*f*) represent the exhaust stroke. Features common to FIGS. 3 and 5 are denoted by common reference numerals. Discharge-inducing high voltage is applied to the spark plugs A (4) and B (5), which serve as a pair of spark plugs, for ignition of the fuel-air gas mixture in the following manner: one of the paired spark plugs; i.e., the positive-polarity spark plug A, is fired in the compression stroke as shown in (*b*), whereas the other one of the paired spark plugs; i.e., the negative-polarity spark plug B, is fired in the compression stroke at a predetermined timing immediately before the top dead center or in transition to the expansion stroke; for example, in the expansion stroke as shown in (c). Thus, combustion efficiency can further be enhanced.

The fuel-air gas mixture contained in the combustion chamber 53 is combusted such that combustion propagates spatially from the spark generation position. Thus, combustion is apt to be delayed in a region distant from the spark generation position or a region behind another spark plug, potentially causing generation of unburnt gas components. In this case, the mounting position of the spark plug B, which performs the second ignition, is determined in consideration of a region where combustion is apt to be delayed with respect to combustion initiated by the spark plug A, which performs the first ignition, thereby further enhancing combustion efficiency. The exhaust valve 55 may be opened before combustion is completed; as a result, in some cases, unburnt gas components present in the vicinity of the exhaust valve 55 may be discharged into an exhaust manifold. Thus, as shown in FIG. 5, disposing the spark plug B, which performs the second ignition, closer to the exhaust valve 55 than is the spark plug A, which performs the first ignition, is an effective measure. This arrangement proves itself far more effective when applied to a lean-burn engine, which uses a lean mixture, which burns at relatively low speed.

Figure 14:
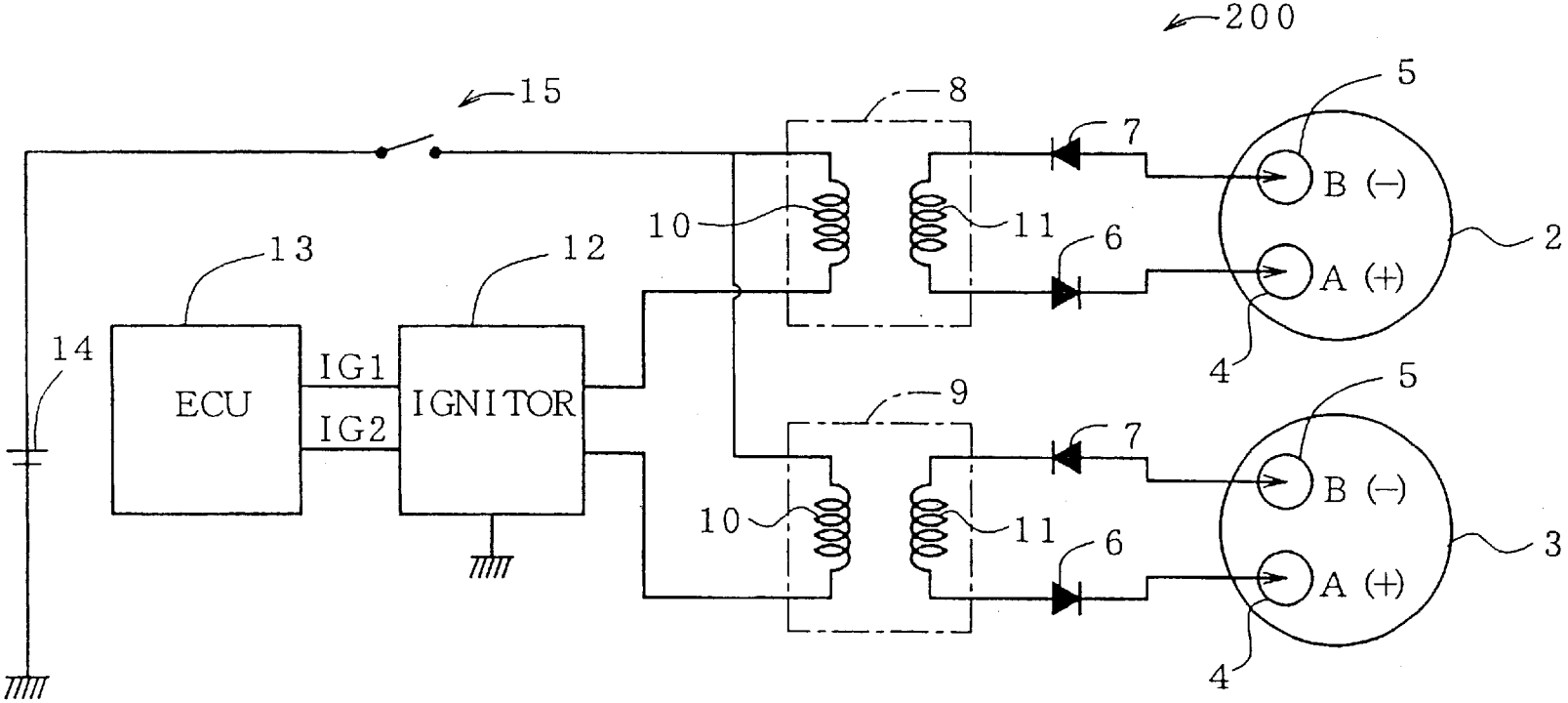
FIG. 14 is a block diagram showing an example of an ignition system in which a positive-polarity spark plug and a negative-polarity spark plug attached to the same cylinder are connected to a common ignition coil.

In contrast to the embodiment of FIG. 1, in which the positive and negative ends of the secondary coil of an ignition coil are connected to the corresponding spark plugs of different cylinders, an ignition system 200 of FIG. 14 is configured such that the positive and negative ends of the secondary coil 11 of an ignition coil 8 (9) provided for a cylinder 2 (3) are connected to the positive-polarity spark plug 4 and the negative-polarity spark plug 5, respectively, of the same cylinder 2 (3). In this case, the positive-polarity spark plugs 4 and the negative-polarity spark plug 5 are simultaneously fired at ignition timing. However, there is no need for refiring the positive- and negative-polarity spark plugs 4 and 5 at a timing other than the ignition timing. Notably, conceptually common features between the ignition system 200 of FIG. 14 and the ignition system 1 of FIG. 1 are denoted by common reference numerals, and redundant description thereof is omitted.

Figure 7:
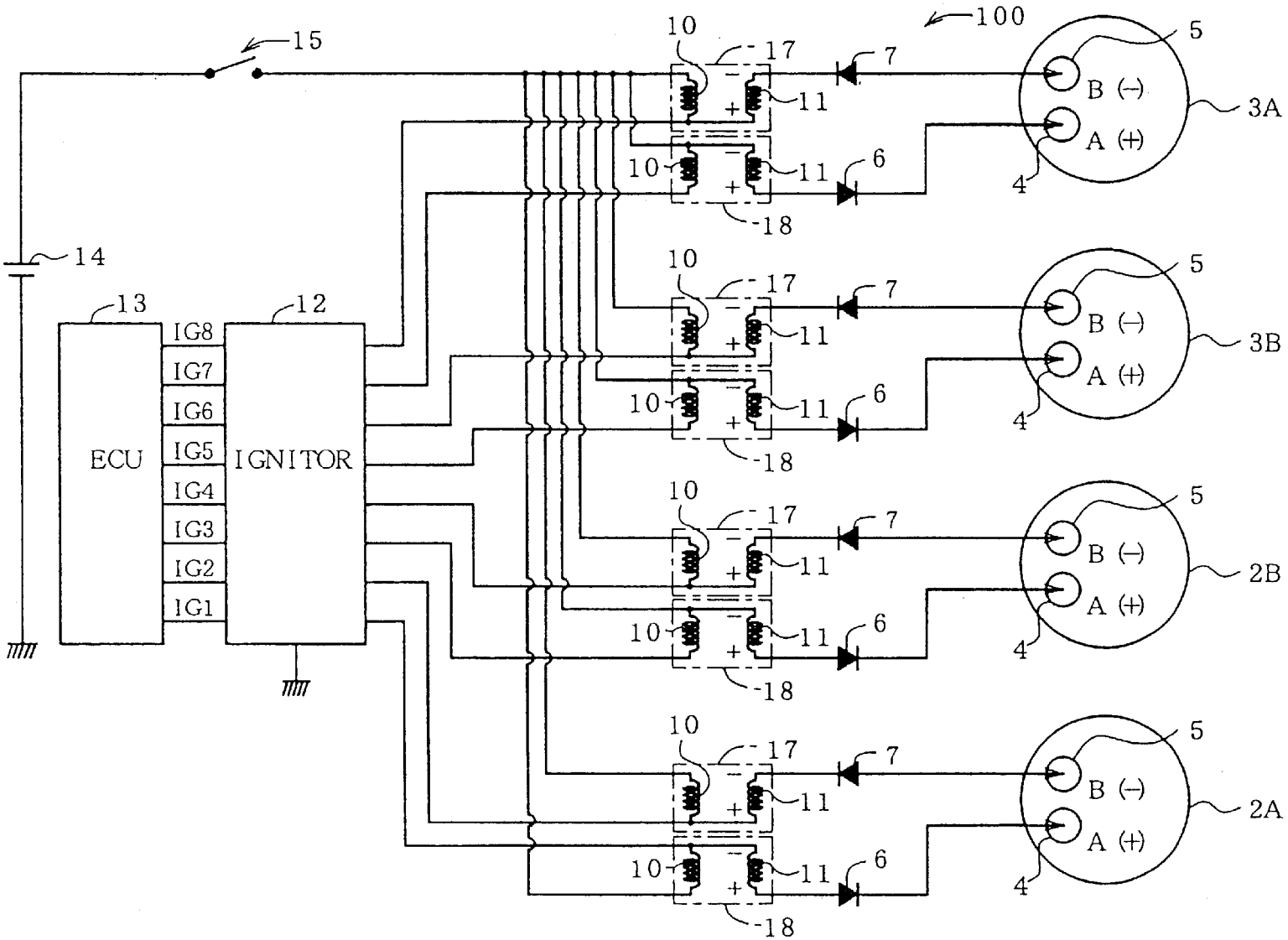
FIG. 7 is a block diagram showing an example of an ignition system in which a positive-polarity spark plug and a negative-polarity spark plug are each provided with an ignition coil.
Figure 8:
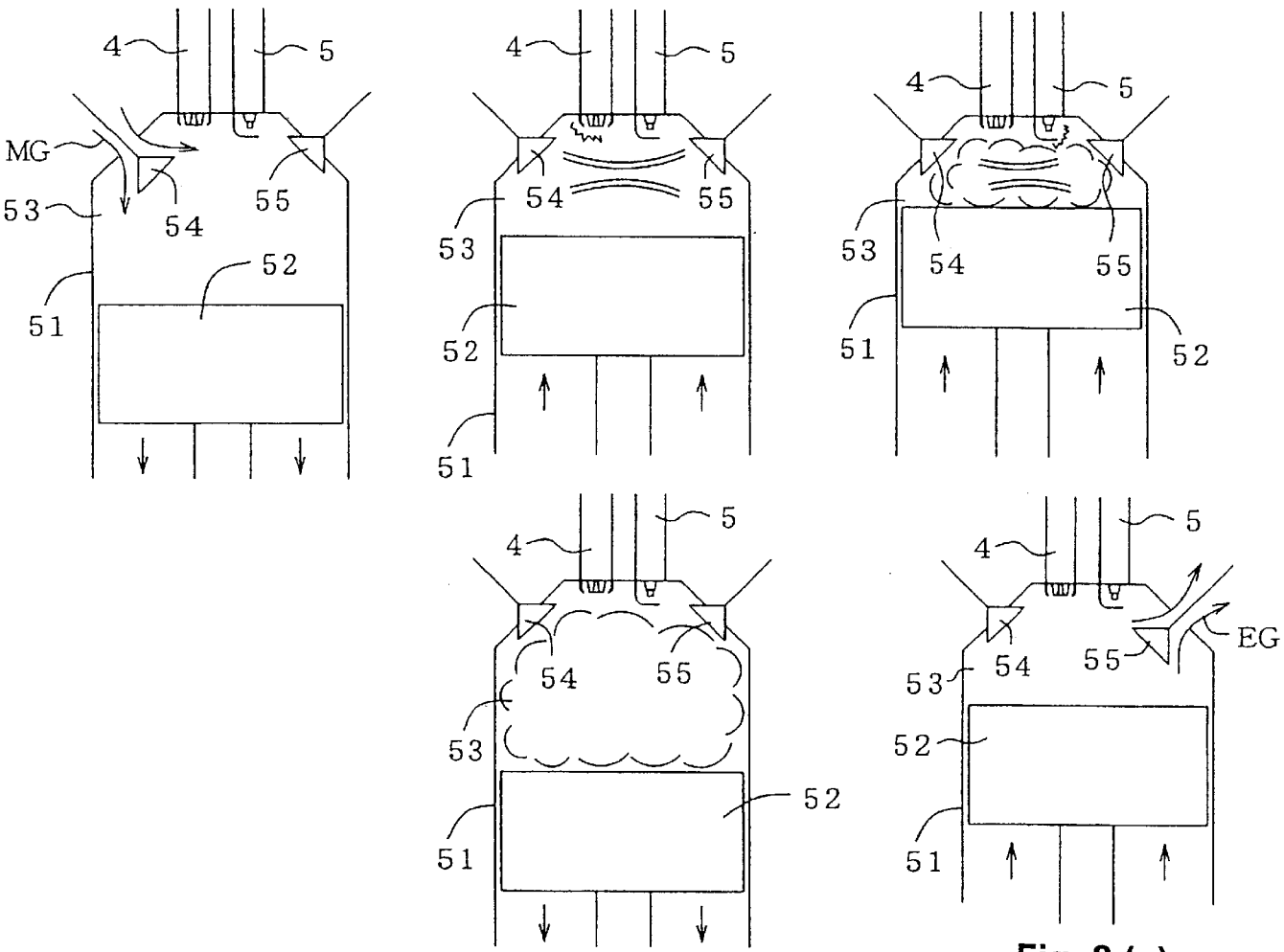
FIG. 8 shows views for explaining the action of cylinders and spark plugs used in the ignition system of FIG. 7.

In FIG. 7, the cylinders 2A, 2B, 3B, and 3A are each provided with a positive-polarity ignition coil 18—the positive end of the secondary coil 11 of which is connected to the positive-polarity spark plug A (4)—and a negative-polarity ignition coil 17—the negative end of the secondary coil 11 of which is connected to the negative-polarity spark plug B (5). An ignition system 100 of FIG. 7 is applied to an internal combustion engine assuming the same configuration as that of FIG. 1, but differs from the ignition system 1 of FIG. 1 in that the ignition coils 18 and 17 are provided for the spark plugs A and B on one-to-one correspondence and are independently operated or controlled via the igniter 12 by means of the individual ports IG1 to IG8 of the ECU 13. Notably, conceptually common features between the ignition system 100 of FIG. 7 and the ignition system 1 of FIG. 1 are denoted by common reference numerals, and redundant description thereof is omitted.

Figure 9:
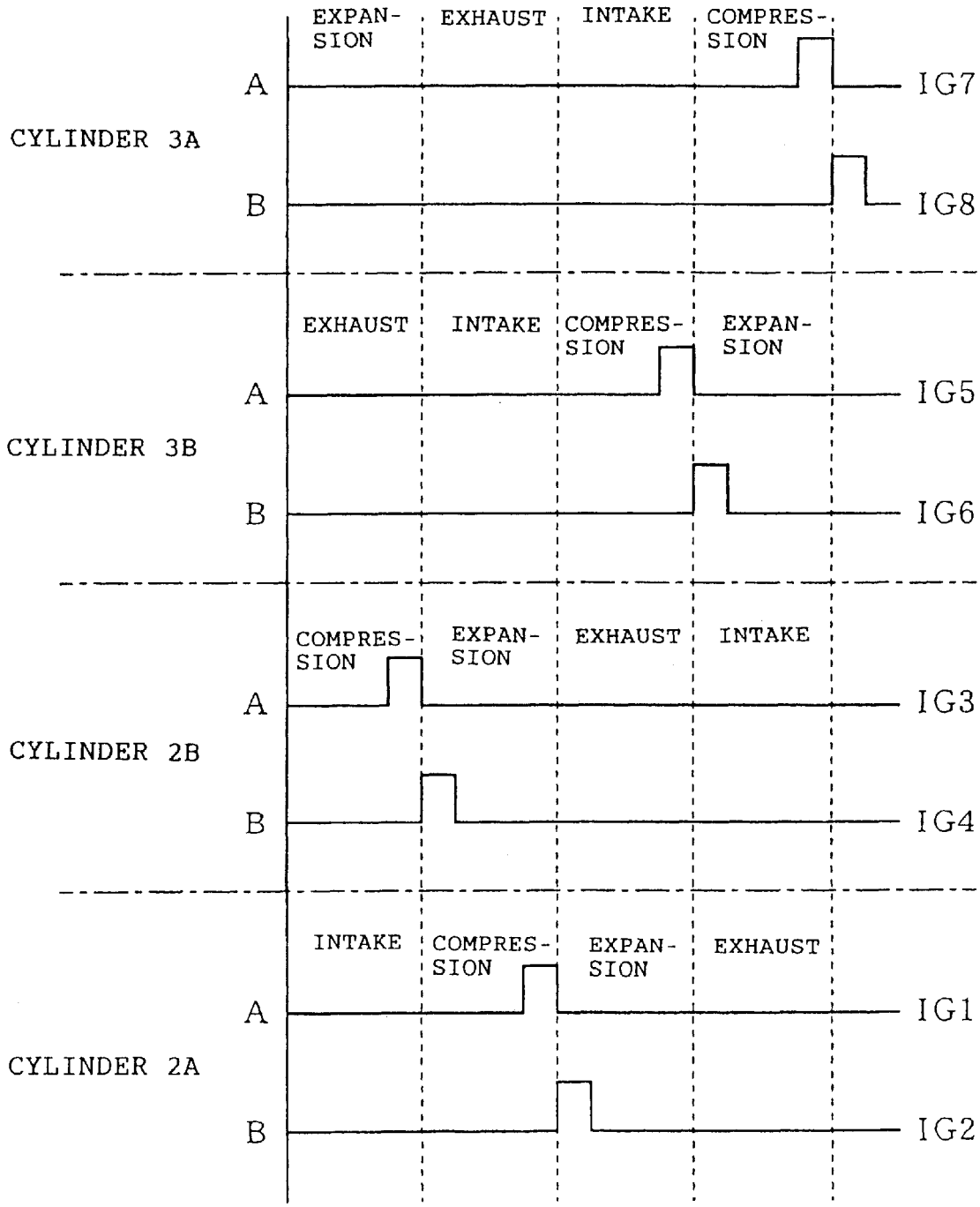
FIG. 9 is a timing chart showing the action of spark plugs corresponding to FIG. 8.

FIG. 9 shows an example chart of ignition timing in this case. Since ignition instruction signals for all the positive-polarity spark plugs A and all the negative-polarity spark plugs B are independently output by means of the individual ports IG1 to IG8, the positive- and negative-polarity spark plugs A and B of each of the cylinders 2A, 2B, 3B, and 3A can be fired only at ignition timing. In contrast to the ignition system 200 of FIG. 14, the positive- and negative-polarity spark plugs A and B of the same cylinder can be fired at different timings. Also, either the positive-polarity spark plug A or the negative-polarity spark plug B can be fired during a certain period of time which is determined according to operating conditions of an engine.

Next, the above-described ignition systems can include a combustion condition judgment mechanism for judging the condition of combustion of a multi-ignition cylinder by the steps of applying a detection voltage to at least one of a plurality of spark plugs attached to the multi-ignition cylinder and detecting information regarding an ion current which flows between electrodes as a result of application of the detection voltage, or information indicative of the level of the ion current. By employing the combustion condition judgment mechanism, knocking, misfire, or contamination of spark plugs can be detected by means of one of the plurality of spark plugs. Since employing sensors for detection of such defective phenomena is not required, the configuration of electric equipment for controlling an internal combustion engine can be simplified. In the case of a lean-burn engine, information regarding the detected condition of combustion can be fed back to control for maintenance of lean-burn combustion. The detection voltage is applied to the spark plug such that a center electrode assumes a positive polarity, to thereby stably generate an ion current.

When frequent execution of the above-mentioned detection is not required, the spark plug used for detection and judgment of the condition of combustion may usually be used for generation of spark discharge and is used for detecting an ion current only when the detection is needed. This arrangement contributes to improving igniting performance and more effective use of spark plugs attached to a cylinder. As mentioned above, since ion current can be generated more stably under a positive polarity, a positive-polarity spark plug, which is a self-cleaning spark plug, preferably assumes the role of detection and judgment of the condition of combustion.

Figure 10:
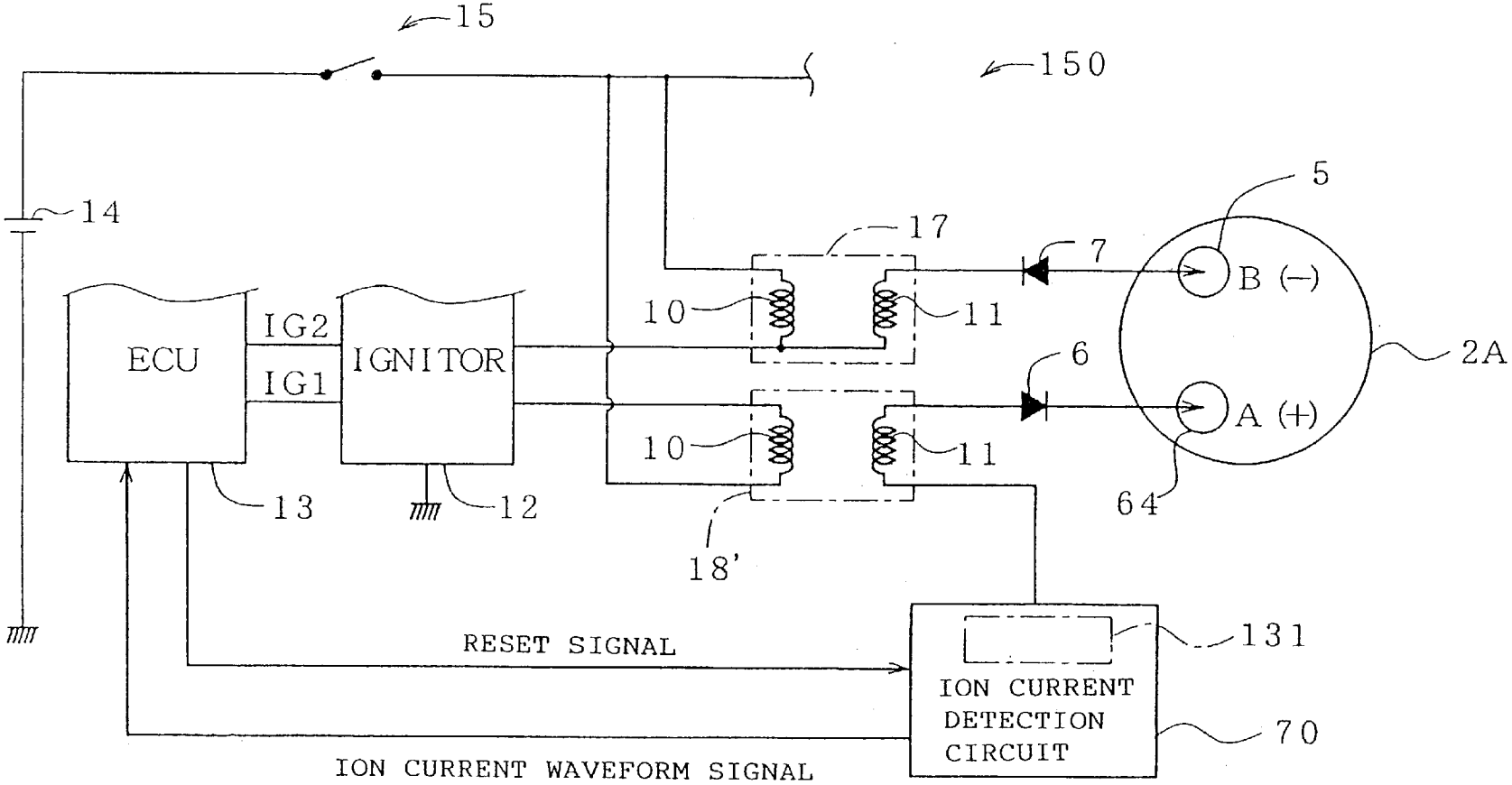
FIG. 10 is a block diagram showing a main portion of an ignition system in which an ion current can be generated at a positive-polarity spark plug.

The above-mentioned function is preferably imparted to, for example, the ignition system 100 of FIG. 7. In this case, as shown in FIG. 10 showing an ignition system 150, an ion current detection circuit 70 must be additionally installed in a line connected to the positive-polarity spark plug A. The ion current detection circuit 70 is an essential component of the combustion condition judgment mechanism and includes a step-up coil element 131 and a current waveform processing circuit 134 as shown in FIG. 11.

Figure 11:
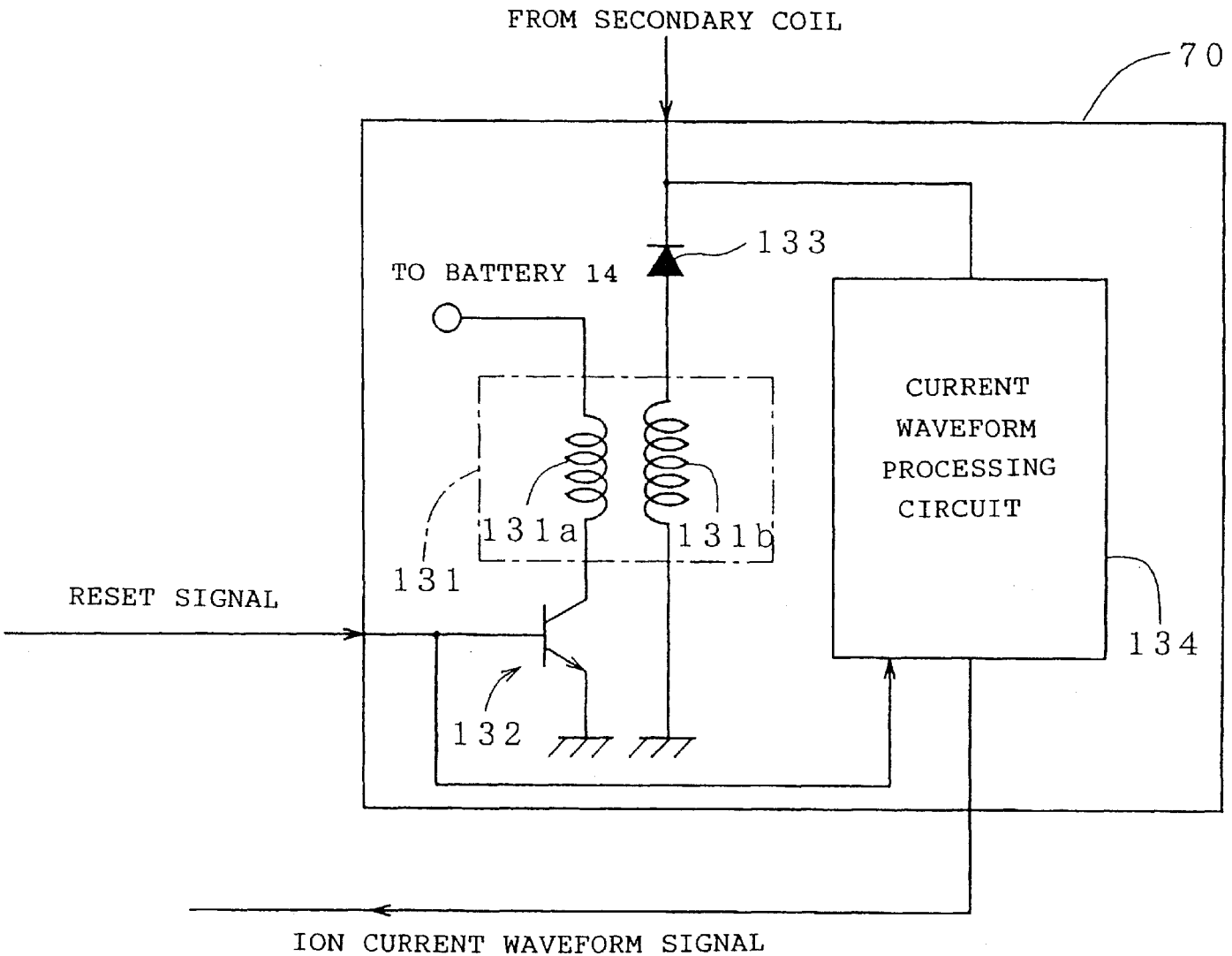
FIG. 11 is a block diagram showing an example of an ion current generation-detection circuit.

Referring to FIGS. 10 and 11, the step-up coil element 131 assumes a structure similar to that of an ignition coil. One end of a primary coil 131*a* receives electricity from a battery 14, whereas the other end of the primary coil 131*a* is grounded via a transistor 132, which serves as a switching element. One end of a secondary coil 131*b* is connected to an end of the secondary coil 11 of a positive-polarity ignition coil 18' which is not connected to the positive-polarity spark plug A, whereas the other end of the secondary coil 131*b* is grounded. In accordance with a reset signal issued from the ECU 13, the transistor 132 is turned on and off in order to energize and de-energize the primary coil 131*a* to thereby generate a detection voltage in the secondary coil 131*b*. The thus-generated detection voltage is output to the spark plug A via the secondary coil 11 of the ignition coil 18'. An ion current which is generated in the spark plug A as a result of applying a detection voltage to the spark plug A is input to the current waveform processing circuit 134, which is disposed on a line branching off from an output line of the secondary coil 131*b*. The waveform processing circuit 134 converts the ion current to a digital-waveform signal, which is an ion current waveform signal, and outputs the signal to the ECU 13. Reference numeral 133 denotes a diode adapted to prevent backflow of an ion current output to the secondary coil 131*b*.

The ECU 13 outputs an instruction to initiate a spark discharge from a port IG2, to thereby cause, via the igniter 12, the positive-polarity spark plug B of each cylinder to initiate a spark discharge. The ECU 13 usually outputs an instruction to the positive-polarity spark plug A from a port IG1 so as to cause, via the igniter 12, the positive-polarity spark plug A to initiate a spark discharge under positive polarity. When a predetermined detection timing is reached, the ECU 13 stops outputting the instruction to initiate a spark discharge (that is, a spark discharge is not performed in one cycle) and outputs a reset signal to the ion current detection circuit 70 from the port IG1. Upon receipt of the reset signal, the ion current detection circuit 70 applies a detection voltage to the positive-polarity spark plug A and detects an ion current. The ion current detection circuit 70 returns a waveform signal indicative of the ion current to the ECU 13 via the current waveform processing circuit 134. The ECU 13 analyzes the received waveform signal to thereby detect various data.

Figure 12:
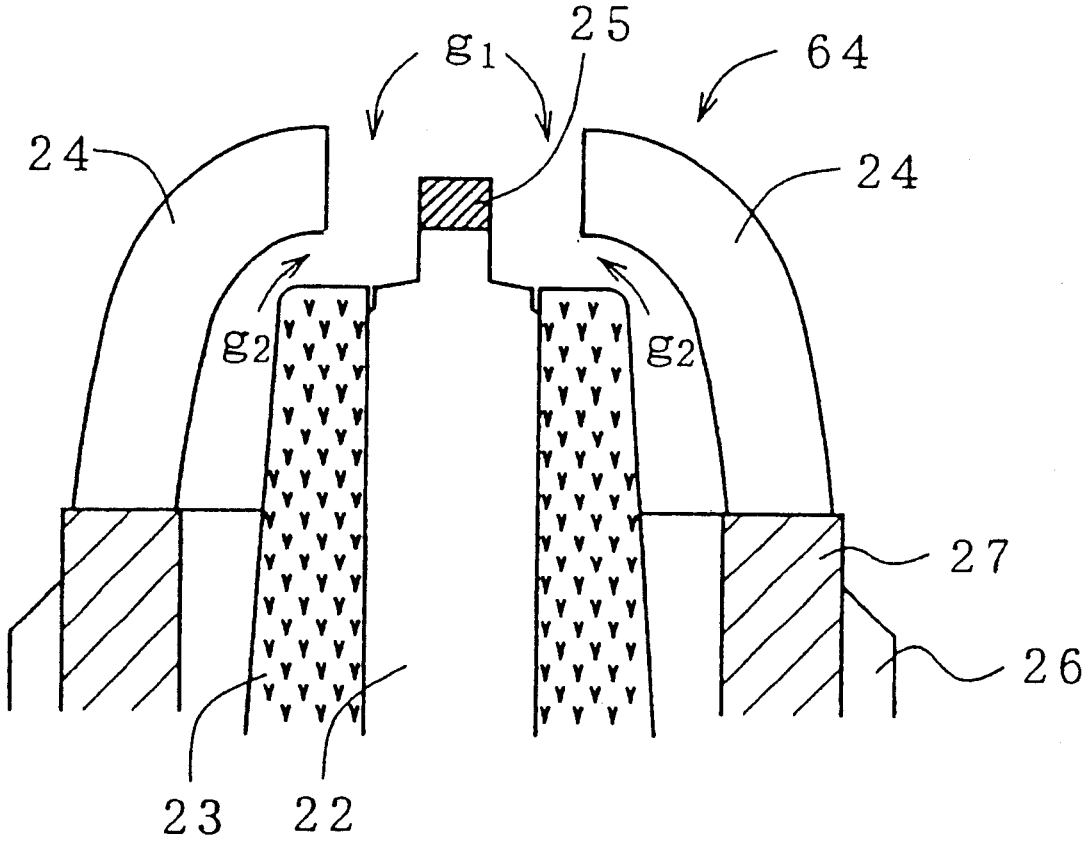
FIG. 12 is a longitudinal sectional view of a main portion of a spark plug, showing an example of an intermittent-surface-gap spark plug.

Examples of a self-cleaning spark plug having a structure suited for generation of an ion current include the semi-surface-gap spark plug 4 of FIG. 2 and an intermittent-surface-gap spark plug 64 shown in FIG. 12. In these spark plugs, the end surface of the ground electrode 24 faces the side surface of the center electrode 22; thus, a broad electrode area can be attained to thereby improve sensitivity in detection of an ion current waveform signal. In the intermittent-surface-gap spark plug 64 of FIG. 12, an end portion of the insulator 23 is not projected into the space between the outer circumferential surface of an end portion of the center electrode 22 and the end surface of the ground electrode 24. The end portion of the center electrode 22 is tapered off, and a noble-metal spark portion 25 is joined to the end surface of the end portion. The center electrode 22 is disposed such that the end portion thereof projects from the insulator 23. The cylindrical metallic shell 27 is disposed so as to surround the insulator 23. A base end of the ground electrode 24 is joined to an end portion of the metallic shell 27, whereas a free end portion of the ground electrode 24 is bent toward the center electrode 22 such that the end surface thereof faces the side surface of the end portion of the center electrode 22 to thereby define a first gap g1 and such that the inner wall surface of the free end portion of the ground electrode 24 faces the end surface of the insulator 23 to thereby define a second gap g2 narrower than the first gap g1. Thus, when contamination of the insulator 23 progresses, a spark discharge occurs across the second gap g2, thereby eliminating the contamination. The thus-configured intermittent-surface-gap spark plug 64 can be used as a self-cleaning spark plug even in the ignition system 1 of FIG. 1, which does not involve detection of an ion current.

Figure 13:
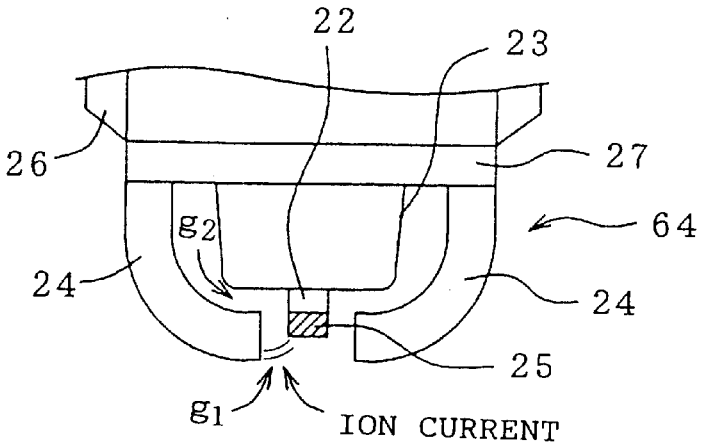
FIG. 13 shows schematic views of a mechanism for detecting and judging the condition of combustion within a cylinder by using an intermittent-surface-gap spark plug as an ion current source, accompanied by several examples of ion current waveforms.
Figure 13:
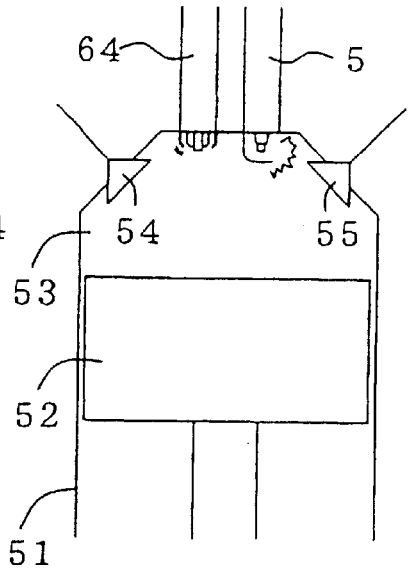
Figure 13:
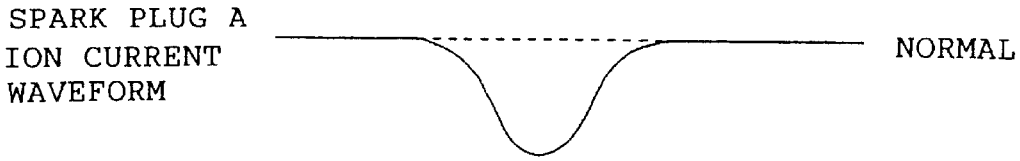
Figure 13:
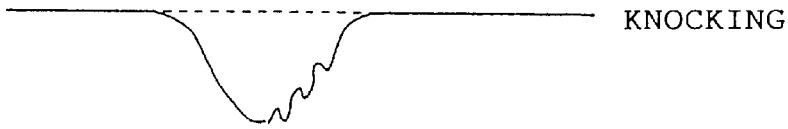
Figure 13:
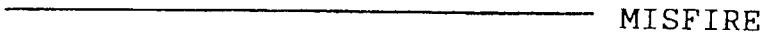
Figure 13:
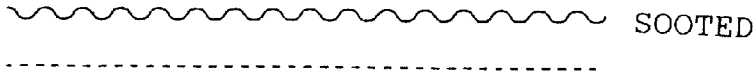

As shown in FIGS. 13(*a*) and 13(*b*), in the case where the intermittent-surface-gap spark plug 64, which serves as a positive-polarity spark plug, detects an ion current when the negative-polarity spark plug B (5) initiates a spark discharge, a detected ion current waveform reflects the condition of combustion of a fuel-air gas mixture, which is ignited and combusted by means of a spark discharge initiated by the negative-polarity spark plug B (5). FIG. 13(*c*) represents a waveform as observed during normal combustion. The waveform includes a peak corresponding to a shock wave induced by combustion/explosion. When knocking occurs, the waveform is disturbed as shown in FIG. 13(*c*). In the case of misfire, no definite peak appears as shown in FIG. 13(*e*). In the case of occurrence of contamination such as soot accumulation, the signal level shifts and is disturbed as shown in FIG. 13(*f*), since a normal ion current is not generated. In any case, the positive-polarity spark plug is not engaged in generation of a spark discharge, but is exclusively engaged in generation of an ion current, thereby greatly enhancing accuracy in detection of the waveform. Accordingly, accuracy in engine control, which is performed in consideration of the detected waveform, can also be greatly enhanced.

Figure 15:
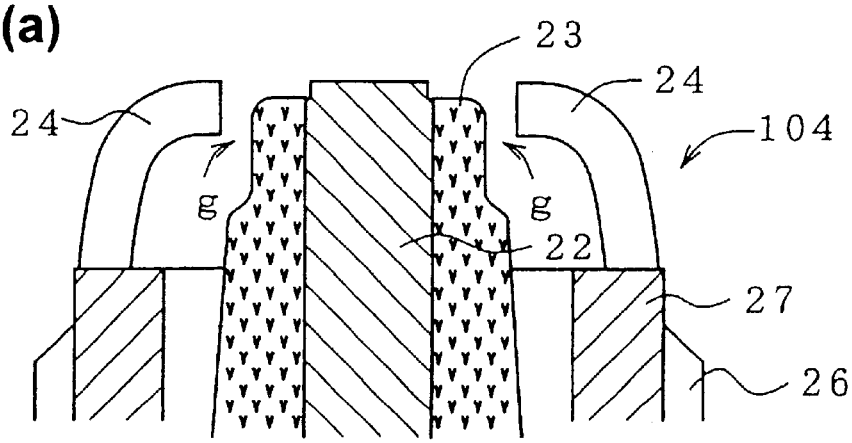
FIG. 15 shows longitudinal sectional views of a main portion of spark plugs, showing modified examples of a self-cleaning spark plug.
Figure 15:
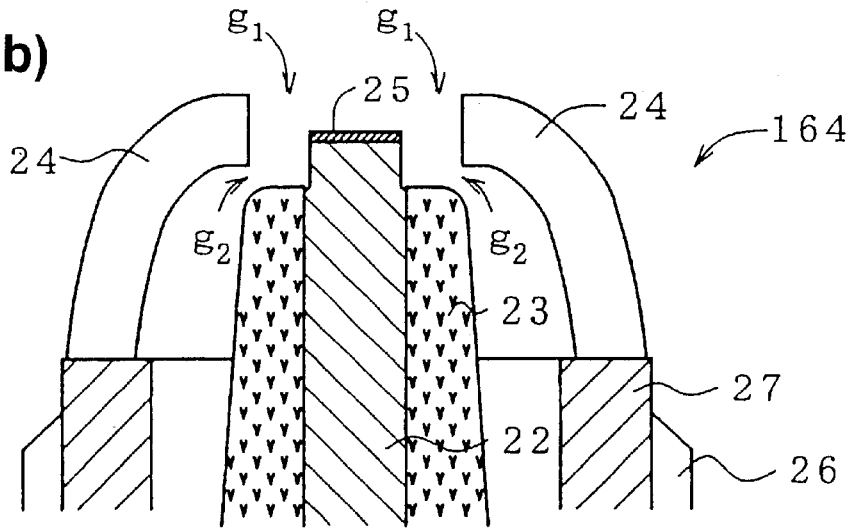
Figure 15:
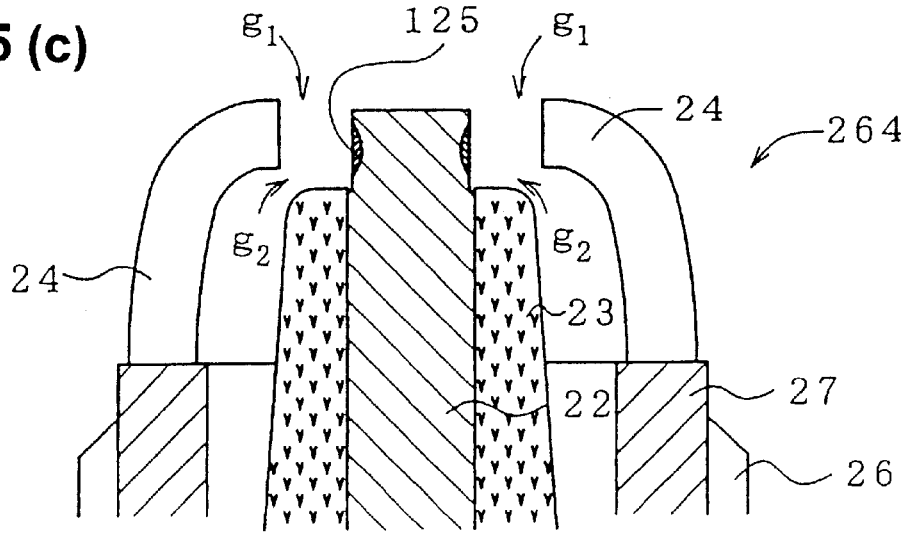
Figure 16:
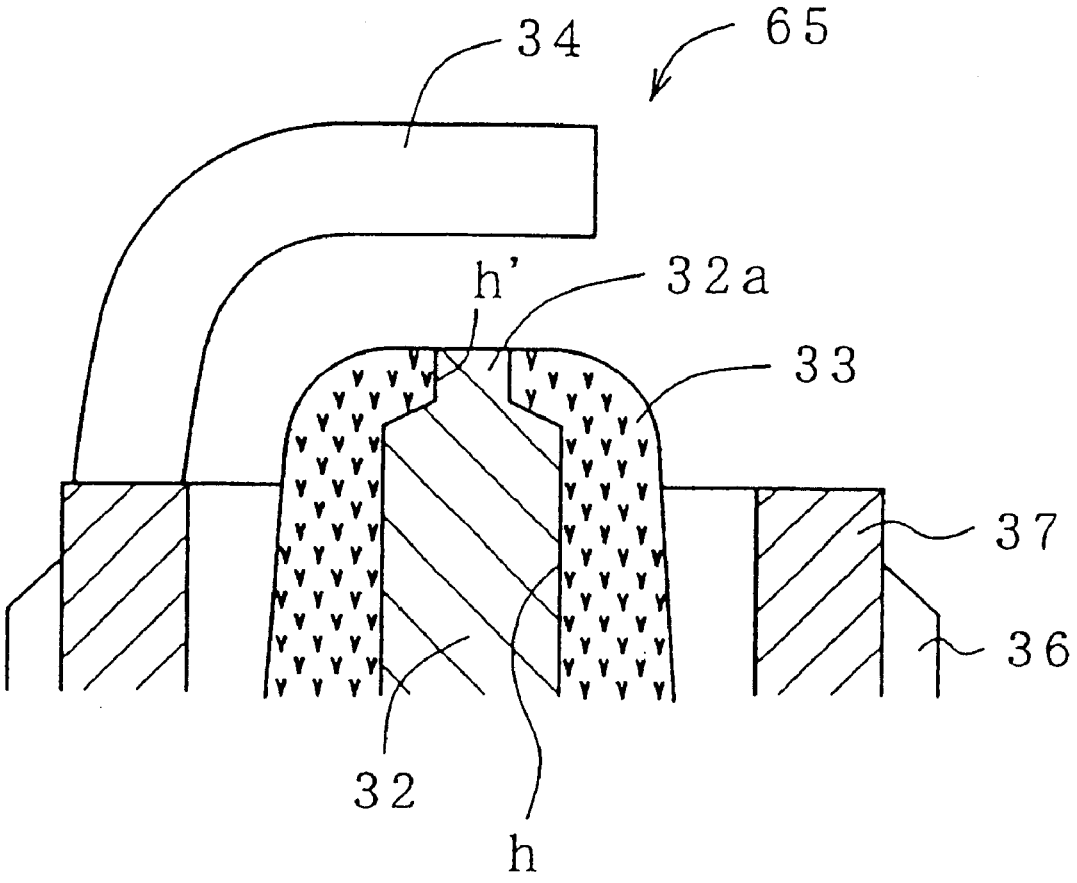
FIG. 16 is a longitudinal sectional view of a main portion of a spark plug, showing another modified example of a self-cleaning spark plug.

FIGS. 15 and 16 show further examples of a self-cleaning spark plug applicable to the present invention (features common to FIGS. 15 and 16 and FIG. 2 or 12 are denoted by common reference numerals). FIG. 15(*a*) shows a semi-surface-gap spark plug 104, in which an end portion of the center electrode 22 projects from the insulator 23. FIG. 15(*b*) shows an intermittent-surface-gap spark plug 164, in which an end portion of the center electrode is not tapered off. FIG. 15(*c*) shows an intermittent-surface-gap spark plug 264, in which a band-shaped noble-metal spark portion 125 is wound on the circumferential surface of a projected end portion of the center electrode 22. FIG. 16 shows an opposed-parallel-electrodes spark plug 65 which serves as a self-cleaning spark plug. An end portion of a through-hole h formed in the insulator 33 is tapered such that the diameter thereof decreases toward the end thereof, thereby forming a diameter-reduced portion h'. The center electrode 32 is inserted into the through-hole h such that a diameter-reduced portion thereof assuming a shape corresponding to that of the diameter-reduced portion h' is fitted into the diameter-reduced portion h' in such manner as to align the end surface of the center electrode 32 with the end surface of the insulator 33. When discharge is initiated such that the center electrode 32 assumes a positive polarity, a spark is generated between the ground electrode 34 and the center electrode 32 in such manner that the spark slightly expands across the end surface of the center electrode, to thereby remove contamination from the surrounding end surface of the insulator 33.

While the invention has been described in detail and with reference to specific embodiments thereof, it will be apparent to one skilled in the art that various changes and modifications can be made therein without departing from the spirit and scope thereof.

This application is based on Japanese Patent Application No. 2000-48232 filed Feb. 24, 2000, the disclosure of which is incorporated herein by reference in its entirety.

What is claimed is:

1. An ignition system for an internal combustion engine having a multi-ignition cylinder equipped with a plurality of spark plugs serving as ignition sources, characterized in that at least one cylinder is equipped with at least one self-cleaning spark plug capable of removing, by means of spark discharge, contaminants adhering to an insulator surface facing a spark discharge gap of said self-cleaning spark plug and at least one non-self-cleaning spark plug.

2. The ignition system for an internal combustion engine as claimed in claim 1, wherein said self-cleaning spark plug is a surface-gap spark plug comprising:

a center electrode;

an insulator, which is disposed around said center electrode such that an end portion of said center electrode is exposed at an end surface of said insulator; and a ground electrode, wherein the relative positions of said ground electrode, an end portion of said insulator and the end portion of said center electrode are determined such that a spark discharge gap is defined between said ground electrode and the end portion of said center electrode and such that the discharge gap enables creeping spark discharge across the surface of the end portion of said insulator.

3. The ignition system for an internal combustion engine as claimed in claim 1, further comprising a high-voltage applicator for applying a discharge-inducing high voltage, for inducing a spark discharge, between the center electrode and the ground electrode of said self-cleaning spark plug such that the center electrode assumes a positive polarity.

4. The ignition system for an internal combustion engine as claimed in claim 3, wherein a male-threaded portion of said self-cleaning spark plug for mounting said self-cleaning spark plug to said cylinder has a nominal size of M12 or M10.

5. The ignition system for an internal combustion engine as claimed in claim 4, wherein said self-cleaning spark plug among the plurality of spark plugs attached to the same multi-ignition cylinder is a positive-polarity spark plug, to which said high-voltage applicator applies a discharge-inducing high voltage such that the center electrode assumes a positive polarity, and the spark plugs other than said self-cleaning spark plug are negative-polarity spark plugs, to each of which said high-voltage applicator applies a discharge-inducing high voltage such that the center electrode assumes a negative polarity.

6. The ignition system for an internal combustion engine as claimed in claim 5, wherein the end surface of a center electrode of each of said negative-polarity spark plugs faces the side surface of a ground electrode.

7. The ignition system for an internal combustion engine as claimed in claim 1, further comprising a high-voltage applicator for applying a discharge-inducing high voltage for igniting a fuel-air gas mixture, to at least two spark plugs among the plurality of spark plugs attached to said multi-ignition cylinder at different timing points.

8. The ignition system for an internal combustion engine as claimed in claim 7, wherein said multi-ignition cylinder is equipped with a positive-polarity spark plug, to which a discharge-inducing high voltage is applied such that a center electrode of the positive-polarity spark plug assumes a positive polarity, and a negative-polarity spark plug, to which a discharge-inducing high voltage is applied such that a center electrode of the negative-polarity spark plug assumes a negative polarity, and wherein said high-voltage applicator applies the discharge-inducing high voltage to the positive- and negative-polarity spark plugs at different timing points such that the positive-polarity spark plug is fired first.

9. The ignition system for an internal combustion engine as claimed in claim 8, wherein said multi-ignition cylinder is a 4-stroke cylinder, and wherein said high-voltage applicator applies the discharge-inducing high-voltage to a pair of spark plugs attached to the 4-stroke cylinder for igniting a fuel-air gas mixture such that one spark plug is fired during a compression stroke immediately before the 4-stroke cylinder reaches a top dead center, whereas the other spark plug is fired during an expansion stroke immediately after the 4-stroke cylinder reaches the top dead center.

10. The ignition system for an internal combustion engine as claimed in claim 1, wherein the internal combustion engine includes a plurality of multi-ignition cylinders, a positive-polarity spark plug and a negative-polarity spark plug are attached to each of the multi-ignition cylinders, a discharge-inducing high voltage is applied to each of the positive-polarity spark plugs such that a center electrode of the positive-polarity spark plug assumes a positive polarity, and a discharge-inducing high voltage is applied to each of the negative-polarity spark plugs such that a center electrode of the negative-polarity spark plug assumes a negative polarity; and wherein an ignition coil of a high-voltage applicator is configured such that a positive end of a secondary coil is connected to a positive-polarity spark plug and a negative end of the same secondary coil is connected to a negative-polarity spark plug.

11. The ignition system for an internal combustion engine as claimed in claim 10, wherein the internal combustion engine is a multi-cylinder-type internal combustion engine including a plurality of multi-ignition cylinders, and wherein said high-voltage applicator comprises components, for generating the discharge-inducing high voltage, which in turn comprise:

a first ignition coil configured such that a positive end of a secondary coil is connected to a positive-polarity spark plug of a first cylinder of said multi-ignition cylinders, whereas a negative end of the secondary coil is connected to a negative-polarity spark plug of a second cylinder of said multi-ignition cylinders, and a second ignition coil configured such that a positive end of a secondary coil is connected to a positive-polarity spark plug of said second cylinder, whereas a negative end of the secondary coil is connected to a negative-polarity spark plug of said first cylinder.

12. The ignition system for an internal combustion engine as claimed in claim 11, wherein said first cylinder and said second cylinder are 4-stroke cylinders operating synchronously while a phase difference of two strokes is maintained therebetween, and wherein said first and second ignition coils each cause a spark plug attached to one of said first and second cylinders to be fired for ignition and simultaneously cause a spark plug attached to the other of said first and second cylinders to be fired at a phase which is substantially two strokes apart from the ignition timing.

13. The ignition system for an internal engine as claimed in claim 1, wherein the internal combustion engine is a multi-cylinder-type internal combustion engine including a plurality of multi-ignition cylinders, a positive-polarity spark plug and a negative-polarity spark plug are attached to each of the multi-ignition cylinders, a discharge-inducing high voltage is applied to each of the positive-polarity spark plugs such that a center electrode of the positive-polarity spark plug assumes a positive polarity, and a discharge-inducing high voltage is applied to each of the negative-polarity spark plugs such that a center electrode of the negative-polarity spark plug assumes a negative polarity; and wherein a high-voltage applicator comprising components for generating the discharge-inducing high voltage is provided for each of the multi-ignition cylinders, said components comprising a positive-polarity ignition coil and a negative-polarity ignition coil, the positive-polarity ignition coil is configured such that a positive end of a secondary coil is connected to a positive-polarity spark plug, and the negative-polarity ignition coil is configured such that a negative end of a secondary coil is connected to a negative-polarity spark plug.

14. The ignition system for an internal combustion engine as claimed in claim 13, wherein said positive-polarity spark plug and said negative-polarity spark plug are fired only at ignition timing in each of the multi-ignition cylinders.

15. The ignition system for an internal combustion engine as claimed in claim 1, further comprising a combustion condition judgment mechanism for judging the condition of combustion of said multi-ignition cylinder comprising means for applying a detection voltage to at least one of the plurality of spark plugs attached to said multi-ignition cylinder and means for detecting information regarding an ion current which flows between said electrodes as a result of application of the detection voltage, or information indicative of the level of the ion current.

16. The ignition system for an internal combustion engine as claimed in claim 15, wherein the detection voltage is applied to said spark plug such that a center electrode assumes positive polarity.

17. An ignition system for an internal combustion engine having a plurality of multi-ignition cylinders, each equipped with a plurality of spark plugs serving as ignition sources, characterized in that:

said multi-ignition cylinders are each equipped with a positive-polarity spark plug, to which a discharge-inducing high voltage is applied such that a center electrode of the positive-polarity spark plug assumes a positive polarity, and a negative-polarity spark plug, to which a discharge-inducing high voltage is applied such that a center electrode of the negative-polarity spark plug assumes a negative polarity; and comprising an ignition coil including a secondary coil having a positive end and a negative end for generating the discharge-inducing high voltage configured such that the positive end of the secondary coil is connected to a positive-polarity spark plug but not to a negative-polarity spark plug, whereas the negative end of the same secondary coil is connected to a negative-polarity spark plug but not to a positive-polarity spark plug.

18. The ignition system for an internal combustion engine as claimed in claim 17, wherein the positive-polarity spark plug and the negative-polarity spark plug which are connected to the same secondary coil are attached to different multi-ignition cylinders.

19. The ignition system for an internal combustion engine as claimed in claim 17, wherein the positive-polarity spark plug and the negative-polarity spark plug which are connected to the same secondary coil are attached to the same multi-ignition cylinder.

* * * * *